United States Patent [19]

Byrnes

[11] 4,089,130

[45] May 16, 1978

[54] ADVERTISING DISPLAY

[76] Inventor: Robert J. Byrnes, 9298 Niver, Allen Park, Mich. 48101

[21] Appl. No.: 670,858

[22] Filed: Mar. 26, 1976

[51] Int. Cl.[2] ..... G09F 7/00

[52] U.S. Cl. ..... 40/613; 40/439

[58] Field of Search ..... 40/137, 138, 128, 126 A, 40/125 A, 106.51, 37, 125 L; 46/157; 272/8, 8 D, 8 N

[56] References Cited

U.S. PATENT DOCUMENTS

| | | | |
|---|---|---|---|
| 2,322,713 | 6/1943 | Hirschhorn | 40/128 |
| 2,398,257 | 4/1946 | Schwartz | 40/106.51 |
| 2,755,576 | 7/1956 | Golden | 40/125 A |
| 2,917,854 | 12/1959 | Swarbrick | 40/106.51 X |
| 3,423,860 | 1/1969 | Berry, Jr. et al. | 40/138 X |
| 3,589,045 | 6/1971 | Rakowsky | 40/137 X |
| 3,774,328 | 11/1973 | Tanney | 40/10 R |

FOREIGN PATENT DOCUMENTS

| | | | |
|---|---|---|---|
| 1,364,050 | 5/1964 | France | 40/137 |
| 338,679 | 3/1936 | Italy | 40/106.43 |
| 339,325 | 12/1930 | United Kingdom | 40/138 |
| 19,521 of | 11/1909 | United Kingdom | 40/138 |

*Primary Examiner*—Louis G. Mancene
*Assistant Examiner*—Wenceslao J. Contreras
*Attorney, Agent, or Firm*—Harness, Dickey & Pierce

[57] ABSTRACT

Several embodiments of low cost advertising displays that achieve a visual or animated effect through the use of air currents or the like. In each embodiment a pair of juxtaposed pieces are supported in spaced relationship and for relative movement. At least one of the pieces is transparent in part and the pieces are formed with markings thereon which give a visual or animation effect upon relative movement between the pieces or upon movement of the viewer relative to the display. In some embodiments, the pieces are integrally connected by relatively thin strips of the same material which permit the relative movement and provide the relative support.

3 Claims, 6 Drawing Figures

FIG. 5.
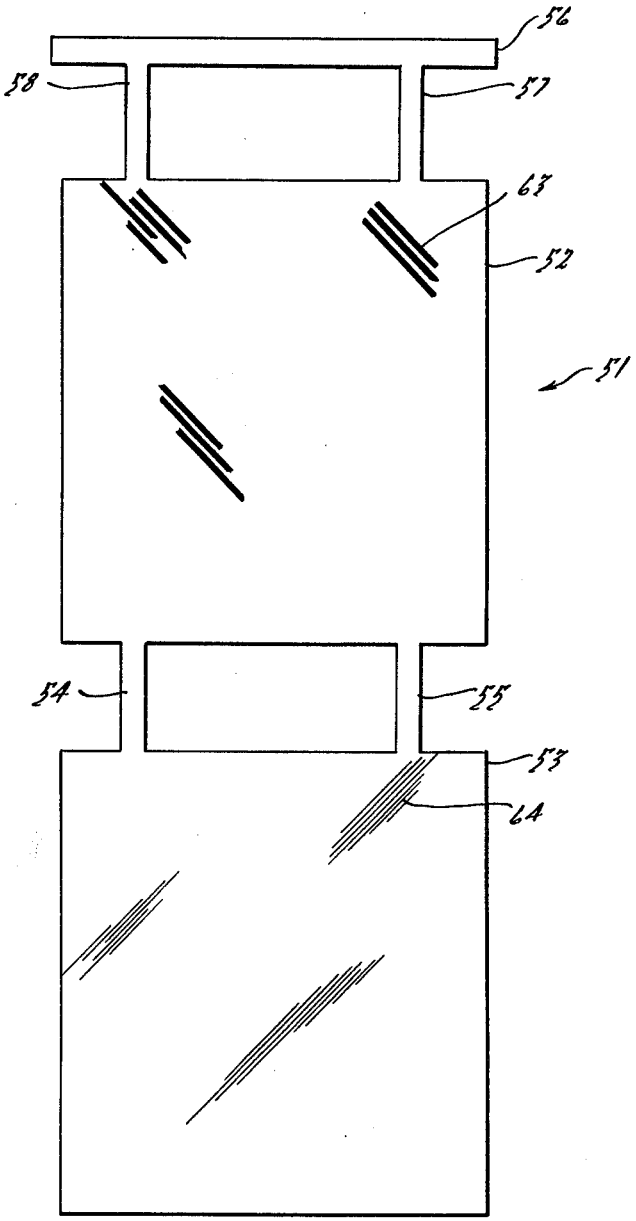
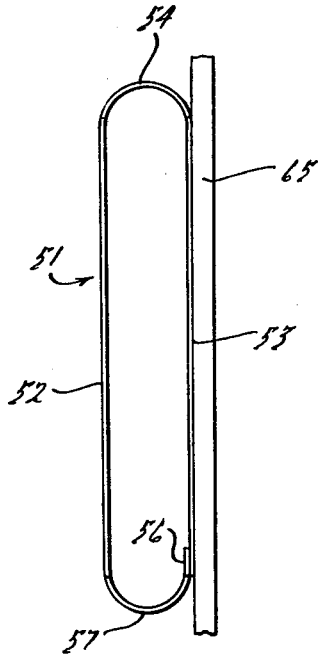
FIG. 6.

ADVERTISING DISPLAY

BACKGROUND OF THE INVENTION

This invention relates to an advertising display and more particularly to an improved and simplified advertising display that creates a visual or animated effect.

A highly effective form of advertising display is one which provides a visual, animation effect. Normally such effects have been provided by incorporating a driving mechanism for moving components of the display relative to each other. Examples of such displays are depicted in my U.S. Pat. No. 3,402,496, entitled "Animation for Advertising Display", issued Sept. 24, 1968. Although the displays shown in that patent are highly effective and relatively low in cost, they nevertheless require a driving force to achieve the animation effect.

It is, therefore, a principal object of this invention to provide an improved and simplified advertising display.

It is another object of the invention to provide an advertising display in which a visual effect is created without the necessity of a driving motor or the like.

SUMMARY OF THE INVENTION

An advertising display embodying this invention is comprised of first and second juxtaposed pieces. At least one of the pieces is transparent, at least in part, so that the other of the pieces may be seen therethrough. Means suspend the pieces in spaced relation relative to each other. Means are formed on at least one of the pieces for creating a visual effect upon relative movement therebetween such as may occur during natural air draft induced movement or upon movement of the observer relative to the display.

BRIEF DESCRIPTION OF THE DRAWINGS

FIG. 5 is a top plan view, in part similar to FIG. 3, showing a still further embodiment of the invention.

FIG. 6 is a side elevational view, in part similar to FIGS. 2 and 4, showing the embodiment of FIG. 5.

DETAILED DESCRIPTION OF THE PREFERRED EMBODIMENTS

Figure 1:
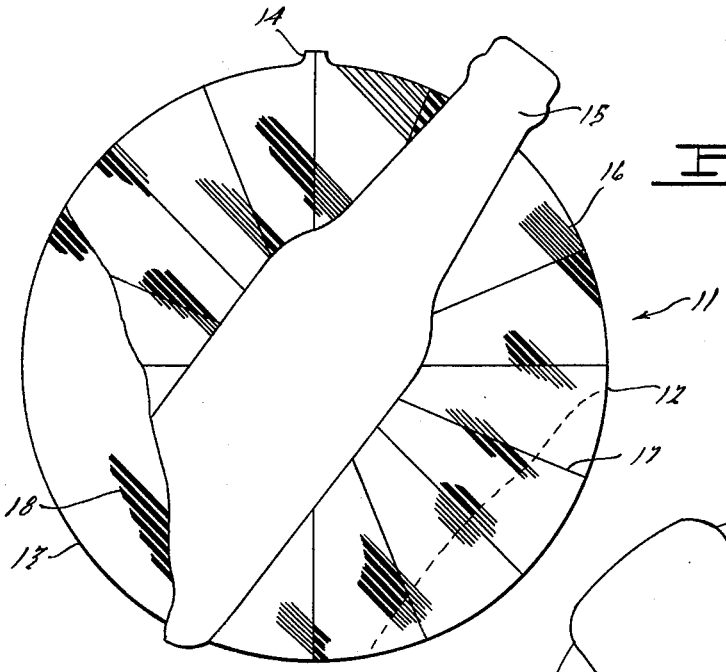
FIG. 1 is an elevational view of an advertising display constructed in accordance with a first embodiment of the invention, with a portion broken away to show the construction.
Figure 2:
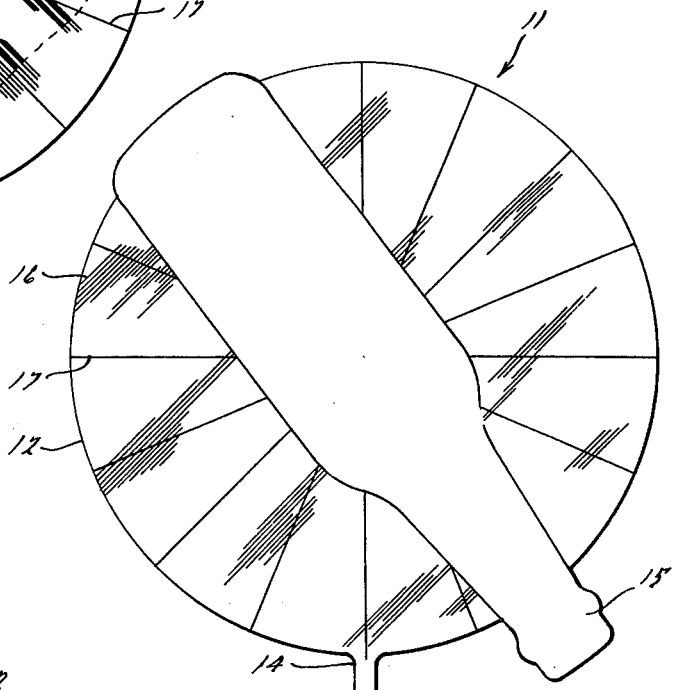
FIG. 2 is a side elevational view of the display shown in FIG. 1.
Figure 3:
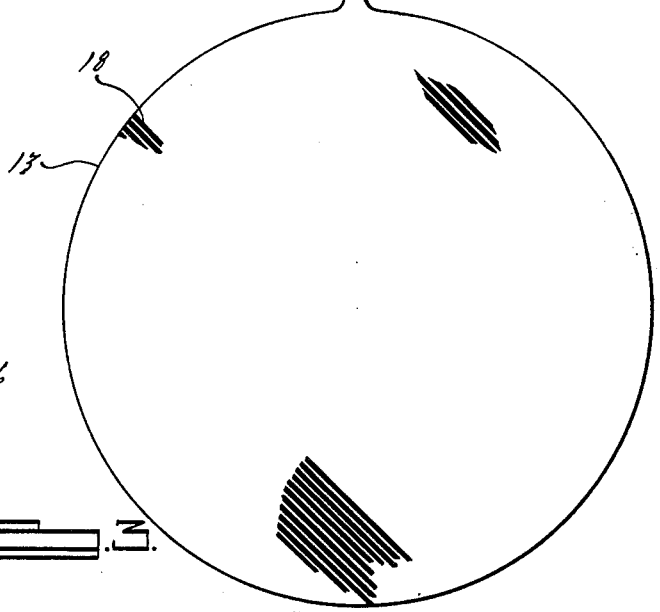
FIG. 3 is a top plan view of the advertising display of FIG. 1, showing the relative components in an opened position.

FIGS. 1 through 3 show a first embodiment of the invention in which an advertising display is identified generally by the reference numeral 11. In this embodiment the advertising display is formed from a single piece of mylar or other transparent material on which suitable markings may be formed. The display 11 is comprised of a first piece 12 and second piece 13. The pieces 12 and 13 are interconnected by a relatively thin strip 14. In the illustrated embodiment, the pieces 12 and 13 each have a circular configuration and the piece 12 is formed with an outline 15 that may simulate the article advertised. Alternatively the outline 15 may be a separate piece fixed to the piece 12.

The piece 12 is formed with a number of angularly disposed lines 16 on its face as well as a plurality of radially extending lines 17. The piece 13 is also formed with angularly disposed lines 18 which may be of a slightly different character than the lines 16. By different character, it is meant that the lines 18 may be of different thickness or angular orientation from the lines 16.

FIG. 2 illustrates the manner in which the advertising display 11 may be used. In this particular utilization of the invention, the piece 13 is formed with a small adhesive strip (not shown) adjacent the interconnecting piece 14 which permits the display 11 to be adhered to a supporting panel 19. The supporting panel may either be a plate glass shop window, door or an opaque wall on which the display 11 is to be mounted. When so mounted, the interconnecting piece 14 will deflect through the inherent resilience of the material and hold the piece 12 in spaced juxtaposed position to the piece 13. Due to the at least partial transparence of the piece 12, the legend 17 on the piece 13 may be seen through the piece 12 or, vice versa, if the mounting element 19 is also transparent.

Due to the thinness and resilience of the interconnecting piece 14 the piece 12 may move slightly relatively to the piece 13 under the influence of air currents. This relative movement will cause the legends 16 and 17 of the piece 12 to move relative to the legend 18 on the piece 13 and create a visual or animation effect. Thus, this effect is created without the need for driving motors or the like. The same effect is created by movement of the viewer relative to the display without the necessity of movement of the piece 12 relative to the piece 13.

Figure 4:
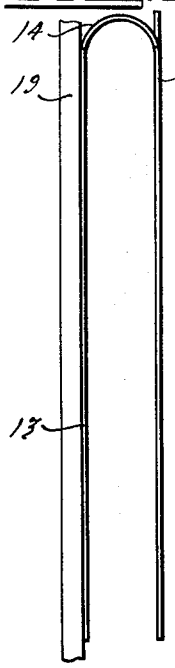
FIG. 4 is a side elevational view, in part similar to FIG. 2, showing another embodiment of the invention.
Figure 4:
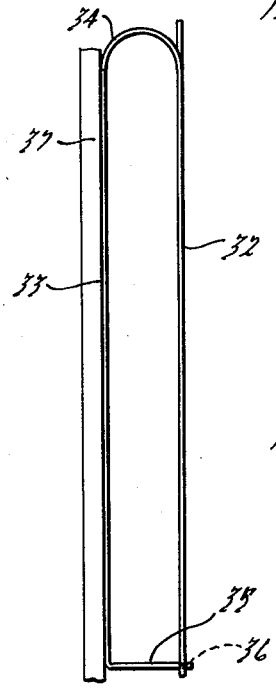

In some instances it may be desirable to space the relative pieces of the advertising display from each other in a more positive manner than in the embodiment previously described. The embodiment of FIG. 4 typifies one way in which this may be done. The advertising display of this embodiment is identified generally by the reference numeral 31. Again, the display is comprised of a first piece 32 and a second piece 33 that are integrally connected together by means of a flexible interconnecting portion 34. The pieces 32 and 33 and the interconnecting piece 34 may be of the same construction as the embodiment of FIGS. 1 through 3 and may carry the same type of animation legend. In this embodiment, however, the piece 32 is formed at its lower edge with an integral tab 35. The tab 35 is adapted to extend through an aperture 36 formed in the piece 33 so as to hold the pieces 32 and 33 in a predetermined spaced relationship at their lower ends. The tab 35 is, however, sufficiently resilient as is the interconnecting piece 34 so as to permit relative movement between the pieces 32 and 33 to achieve the desired animation effect. As in the previously described embodiment, the display 31 may be supported on a panel 37 by means of adhesive or the like.

FIGS. 5 and 6 illustrate still another embodiment of the invention in which spacing is provided at both ends of the display. In this embodiment, the display is identified generally by the reference numeral 51. As in the previously described embodiments, the display 51 is comprised of a first piece 52 and a second piece 53. In this particular embodiment, the pieces 52 and 53 have a square configuration, although other shapes are possible with all described embodiments. The pieces 52 and 53 are interconnected by resilient interconnecting members 54 and 55 that are integrally formed with the pieces 52 and 53. An attaching member 56 is connected to the remote edge of the piece 52 by means of resilient interconnecting members 57 and 58.

As in the previously described embodiments, either or both of the pieces 52 and 53 are transparent and are formed with appropriate animation legends 63 and 64, respectively, on their faces. In use, the device is mounted on a glass or opaque panel, indicated by the reference numeral 65 in FIG. 6. To achieve this, a portion of the piece 53 is coated with an adhesive, so that the piece 53 is adhered to the supporting panel 65. The piece 52 is then folded back over to overlie the piece 53 by deflection of the interconnecting pieces 54 and 55. The attaching member 56, which is also adhesive coated is then adhered to either the panel 65 or to the piece 53. The interconnecting pieces 54, 55 and 57, 58 will then hold the pieces 52 and 53 in a spaced relationship while permitting some limited relative movement. As in the previously described embodiments, the animation effect is created by relative movement between the pieces 52 and 53, or by movement of the viewer relative to the display 51.

In all of the described embodiments it has been assumed that the two pieces of the advertising display are integrally connected and are formed from the same, transparent material. It should be obvious to those skilled in the art that only one of the pieces need be transparent and that the pieces need not be integrally connected together. Such integral connection is, however, a preferred form of the invention since it minimizes the number of separate pieces which a user must assemble. Furthermore, it is possible that the supporting element, which has been described as a glass panel, wall or the like, may form itself one of the pieces of the display. That is, the other piece may include tabs or supporting strings that are directly affixed to the supporting member and which cooperates with the supporting member to achieve the animation effect. Various other changes and modifications are within the scope of the invention and may be made without departing from its spirit, as defined by the appended claims.

I claim:

1. An air current actuated advertising display comprising a first piece, a second piece juxtaposed to said first piece, and unitarily connected thereto, at least one of said pieces being transparent at least in part so that the other of said pieces may be seen therethrough, means comprising resilient means unitarily formed with one of said pieces for suspending said pieces in spaced relation relative to each other, said resilient means being sufficiently resilient to permit relative movement upon normal air currents encountered in the area of support, and means formed on at least one of said pieces creating a visual effect upon relative motion between said pieces and upon relative movement between a viewer and said display, the unitary supporting means being disposed at opposite sides of the respective pieces for holding the opposite sides in spaced relationship.

2. An advertising display as set forth in claim 1 wherein at least one of the unitary means comprises a tab interlocked with a slot on the other piece.

3. An advertising display as set forth in claim 1 wherein at least one of the interconnecting means is adhesive coated to facilitate support of the pieces on an associated panel and for affixing the pieces to each other.

* * * * *